US009640923B2

(12) United States Patent
Kao et al.

(10) Patent No.: US 9,640,923 B2
(45) Date of Patent: May 2, 2017

(54) ELECTRICAL RECEPTACLE CONNECTOR WITH SHIELDING AND GROUNDING FEATURES

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Mao-Sheng Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/944,218

(22) Filed: Nov. 18, 2015

(65) Prior Publication Data

US 2016/0149350 A1 May 26, 2016

(30) Foreign Application Priority Data

Nov. 21, 2014 (TW) ..... 103140596 A

(51) Int. Cl.

| | |
|---|---|
| ***H01R 13/648*** | (2006.01) |
| ***H01R 24/60*** | (2011.01) |
| ***H01R 12/72*** | (2011.01) |
| ***H01R 13/6585*** | (2011.01) |
| *H01R 107/00* | (2006.01) |

(52) U.S. Cl.

CPC ..... *H01R 24/60* (2013.01); *H01R 12/724* (2013.01); *H01R 13/6585* (2013.01); *H01R 2107/00* (2013.01)

(58) Field of Classification Search

CPC ..... H01R 13/6585; H01R 24/60; H01R 2107/00; H01R 13/6586; H01R 12/724

USPC ..... 439/607.05, 676, 941.1

See application file for complete search history.

(56) References Cited

U.S. PATENT DOCUMENTS 9,153,895 B2 * 10/2015 Kao ..... H01R 13/65802 439/607.01

FOREIGN PATENT DOCUMENTS

| | | |
|---|---|---|
| TW | M481526 U | 7/2014 |
| TW | M486881 | 9/2014 |
| TW | M490142 U | 11/2014 |

OTHER PUBLICATIONS

Machine translation of M490142.*

* cited by examiner

*Primary Examiner* — Javaid Nasri

(74) *Attorney, Agent, or Firm* — Winston Hsu; Scott Margo

(57) ABSTRACT

An electrical receptacle connector includes a receptacle shell, an insulation housing bracket, a receptacle grounding contact, and a grounding member. The insulation housing bracket is disposed inside the receptacle shell. The receptacle grounding contact is held inside the housing base. The grounding member is disposed on a first side of the insulation housing bracket and located between the insulation housing bracket and the receptacle shell. A connecting structure is selectively disposed on the grounding member or on the receptacle grounding contact. The connecting structure penetrates through the insulation housing bracket and mechanically or physically connects the grounding member and the receptacle grounding contact such that the grounding member is electrically connected to the receptacle grounding contact.

26 Claims, 10 Drawing Sheets

ELECTRICAL RECEPTACLE CONNECTOR WITH SHIELDING AND GROUNDING FEATURES

BACKGROUND OF THE INVENTION

1. Field of the Invention

The present invention relates to an electrical receptacle connector, and more particularly, to an electrical receptacle connector adapted for a Universal Serial Bus interface and capable of reducing high frequency interferences and electromagnetic interferences.

2. Description of the Prior Art

With the development of computer and peripheral equipment industry, a Universal Serial Bus (USB) interface has become one of important interfaces for communication and data transmission between computers and peripheral equipment. As technology advances, high speed transmission is a trend, and there is a need to develop an electrical connector with high speed transmission. Furthermore, with the trend of an electrical device with thin thickness, the electrical connector with thin thickness is required. The electrical connector with high speed transmission and thin thinness results in high frequency interferences (HFIs) and electromagnetic interferences (EMIs) among contacts of the electrical connector or between the coupled electrical connectors. Thus, it impacts on performance of high frequency transmission or high speed transmission between a USB electrical plug connector and a USB electrical receptacle connector and may impact on normal performance of an electrical device to which the aforesaid connectors are coupled, such as a Bluetooth device, a mobile phone, a laptop, a tablet, or a hard disc drive. Therefore, it has become an important topic to design a new USB electrical plug connector with capability of thin thinness, high speed transmission, and reliability as well as reducing HFIs and EMIs due to thin thickness and high speed transmission of the electrical connectors.

SUMMARY OF THE INVENTION

The present invention provides an electrical receptacle connector adapted for a Universal Serial Bus (USB) interface and capable of reducing high frequency interferences and electromagnetic interferences for solving above drawbacks.

According to the claimed invention, an electrical receptacle connector includes an insulation housing bracket, a first receptacle grounding contact, a first shell and a first grounding member. The insulation housing bracket has a first side. The first receptacle grounding contact is disposed inside the insulation housing bracket. An accommodating space is enclosed in the first shell and for accommodating the insulation housing bracket and the first receptacle grounding contact. The first grounding member is disposed on the first side of the insulation housing bracket and located between the insulation housing bracket and the first shell. The first grounding member mechanically contacts with the first receptacle grounding contact, such that the first grounding member is electrically connected to the first receptacle grounding contact.

According to the claimed invention, the first grounding member includes a first connecting structure protruding from the first grounding member and contacting with the first receptacle grounding contact, such that the first grounding member is electrically connected to the first receptacle grounding contact.

According to the claimed invention, the first connecting structure is a protrusion portion or a spring arm, and the first connecting structure and the first grounding member are integrally formed.

According to the claimed invention, the first receptacle grounding contact includes a first connecting structure protruding from the first receptacle grounding contact and contacting with the first grounding member, such that the first grounding member is electrically connected to the first receptacle grounding contact.

According to the claimed invention, the first connecting structure is a contact bending structure, and the first connecting structure and the first receptacle grounding contact are integrally formed.

According to the claimed invention, the insulation housing bracket has a second side opposite to the first side, and the electrical receptacle connector further includes a second receptacle grounding contact and a second grounding member. The second receptacle grounding contact is disposed inside the insulation housing bracket and opposite to the first receptacle grounding contact. The second grounding member is disposed on the second side of the insulation housing bracket and located between insulation housing bracket and the first shell. The second grounding member is electrically connected to the second receptacle grounding contact in a mechanically contacting manner.

According to the claimed invention, the second grounding member includes a second connecting structure protruding from the second grounding member and contacting with the second receptacle grounding contact, such that the second grounding member is electrically connected to the second receptacle grounding contact. The second connecting structure is a protrusion portion or a spring arm, and the second connecting structure and the second grounding member are integrally formed.

According to the claimed invention, the second receptacle grounding contact includes a second connecting structure protruding from the second receptacle grounding contact and contacting with the second grounding member, such that the second grounding member is electrically connected to the second receptacle grounding contact. The second connecting structure is a contact bending structure, and the second connecting structure and the second receptacle grounding contact are integrally formed.

According to the claimed invention, the electrical receptacle connector further includes a first signal contact set, a second signal contact set and a shielding member. The first signal contact set is arranged alongside the first receptacle grounding contact. The second signal contact set is arranged alongside the second receptacle grounding contact. The shielding member is disposed between the first signal contact set and the second signal contact set. The shielding member is for shielding the first signal contact set and the second signal contact set.

According to the claimed invention, the insulation housing bracket includes a first insulator and a second insulator. The second insulator is detachably assembled on the first insulator. The first grounding member is installed on the first insulator. The second grounding member is installed on the second insulator, and the first insulator and the second insulator clamp the shielding member cooperatively.

According to the claimed invention, the first grounding member includes a first grounding body and a first abutting portion. The first grounding body is installed on a side of the first insulator. The first connecting structure is connected to the first grounding body. The first abutting portion protrudes from the first grounding body. The first abutting portion abuts against the first shell, such that the first grounding body is electrically connected to the first shell.

According to the claimed invention, the second grounding member includes a second grounding body and a second abutting portion. The second grounding body is installed on a side away from the first grounding body and of the second insulator. The second connecting structure is connected to the second grounding body. The second abutting portion protrudes from the second grounding body. The second abutting portion abuts against the first shell, such that the second grounding body is electrically connected to the first shell.

According to the claimed invention, the first grounding member further includes a first mounting leg protruding from the first grounding body and embedding into the first insulator, and the second grounding member further includes a second mounting leg protruding from the second grounding body and embedding into the second insulator.

According to the claimed invention, the shielding member includes a shielding body, a latching structure, a grounding portion and a fixing portion. The latching structure protrudes from the shielding body and is for latching an electrical plug connector. The grounding portion protrudes from a side opposite to the latching structure and of the shielding body. The grounding portion is coupled to a circuit board. The fixing portion protrudes from the shielding body and located between the latching structure and the grounding portion. The fixing portion is for fixing with the circuit board.

According to the claimed invention, the electrical receptacle connector further includes a second shell. The second shell includes a casing and a welding portion. The casing is fixed on the first shell in a laser welding manner. The welding portion protrudes from the casing and is mounted on the circuit board.

According to the claimed invention, the second shell further includes a first engaging structure being formed on the casing and engaging with the first shell.

According to the claimed invention, an electrical receptacle connector includes a first terminal module, a second terminal module, a first shell and a first grounding member. The first terminal module includes a first insulator, a first signal contact set and two first receptacle grounding contacts. The first signal contact set is disposed inside the first insulator. The two first receptacle grounding contacts are disposed inside the first insulator and arranged alongside the first signal contact set, the two first receptacle grounding contacts are disposed on two opposite sides of the first signal contact set respectively. The second terminal module includes a second insulator, a second signal contact set and two second receptacle grounding contacts. The second insulator is assembled with the first insulator to form an insulation housing bracket. The second signal contact set is disposed inside the second insulator. The two second receptacle grounding contacts are disposed inside the second insulator and arranged alongside the second signal contact set. The two second receptacle grounding contacts are disposed on two opposite sides of the second signal contact set respectively. The first shell is with an accommodating space enclosed therein. The accommodating space is for accommodating the first terminal module and the second terminal module. The first grounding member is disposed on a first side of the insulation housing bracket and located between the insulation housing bracket and the first shell. The first grounding member mechanically contacts with the first receptacle grounding contact, such that the first grounding member is electrically connected to the first receptacle grounding contact.

According to the claimed invention, each of the first signal contact set and second signal contact set includes at least two pairs of differential signal contacts. The differential signal contacts of the first signal contact is symmetric to the differential signal contacts of the second signal contact set by rotation of 180 degrees along a front-back direction of the electrical receptacle connector.

In summary, the present invention utilizes the first connecting structures and the first abutting portion for electrically connecting the receptacle shell, the first grounding member, and the first receptacle grounding contact, and further utilizes the second connecting structures and the second abutting portion for electrically connecting the receptacle shell, the second grounding member, and the second receptacle grounding contact, such that electromagnetic noises and electromagnetic interferences are reduced when the electrical receptacle connector is transmitting high frequency signals, which improves performance of high frequency transmission or high speed transmission of the electrical receptacle connector. Furthermore, the present invention further utilizes the shielding member disposed between the first signal contact set and the second signal contact set for shielding the first signal contact set and the second signal contact set for preventing interferences and crosstalk generated between the first signal contact set and the second signal contact set.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
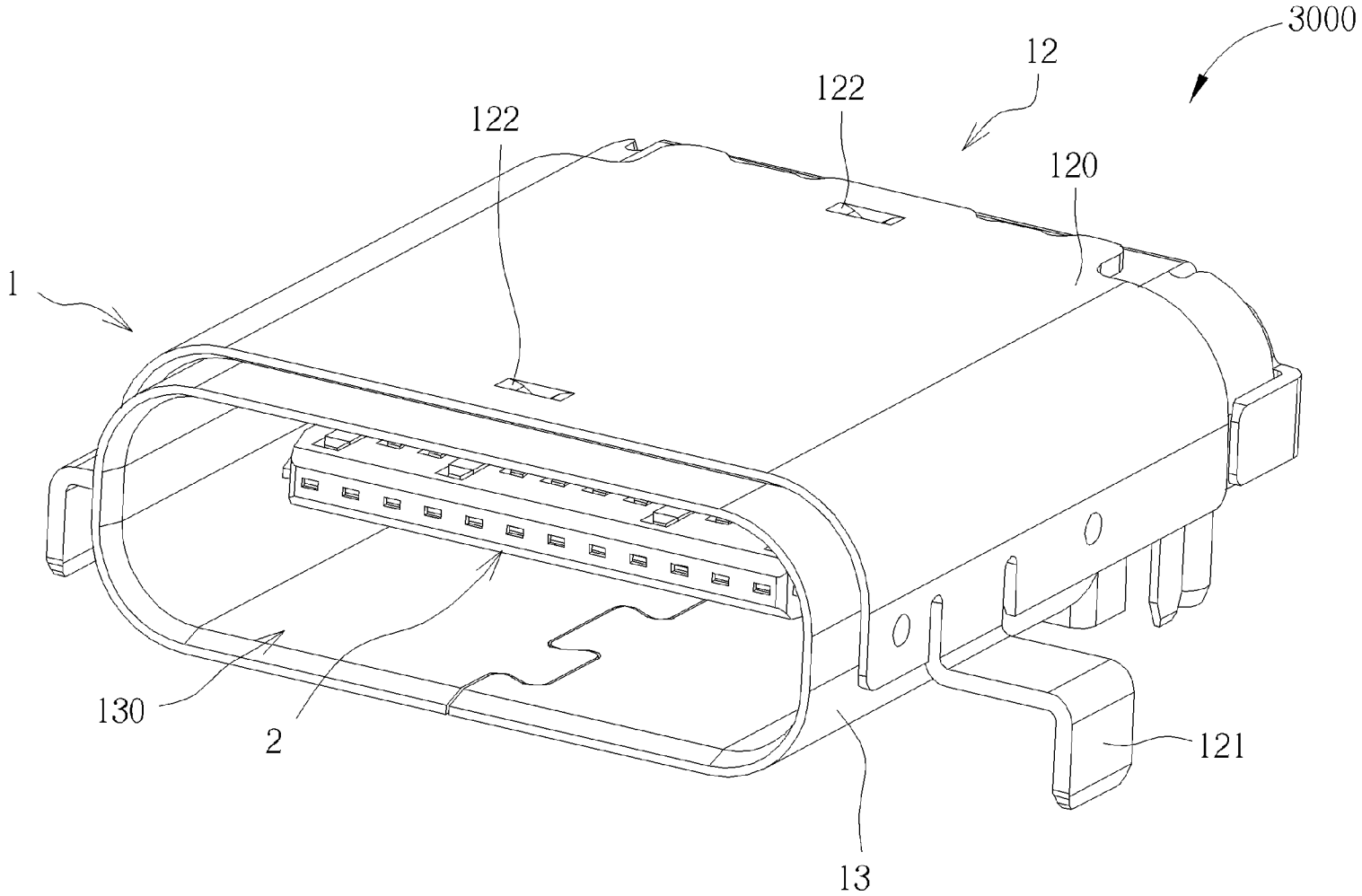
FIG. 1 is a schematic diagram of an electrical receptacle connector according to a first embodiment of the present invention.
Figure 2:
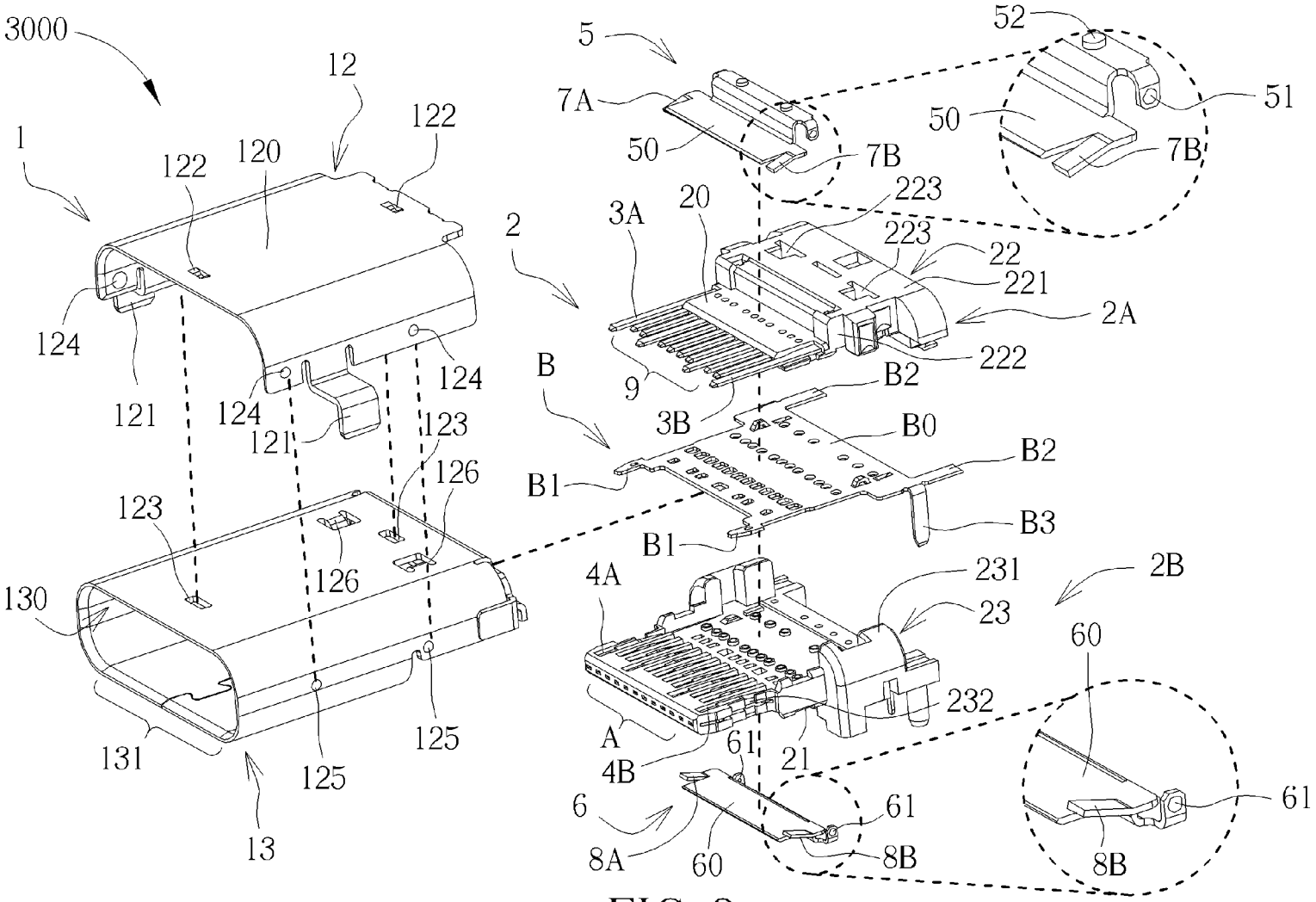
FIG. 2 and FIG. 3 are exploded diagrams of the electrical receptacle connector in different views according to the first embodiment of the present invention.
Figure 3:
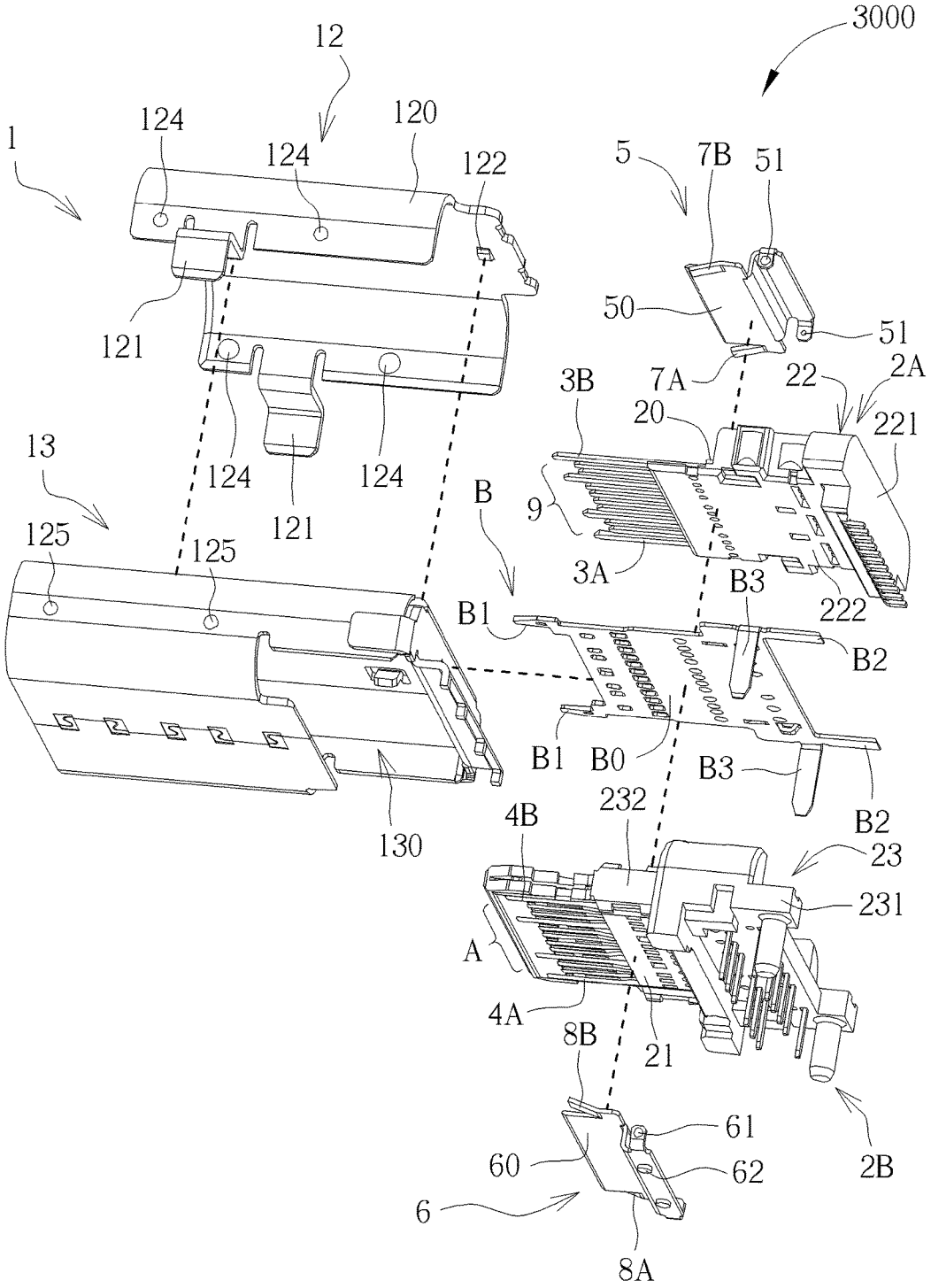

Please refer to FIG. 1 to FIG. 3. FIG. 1 is a schematic diagram of an electrical receptacle connector 3000 according to a first embodiment of the present invention. FIG. 2 and FIG. 3 are exploded diagrams of the electrical receptacle connector 3000 in different views according to the first embodiment of the present invention. As shown in FIG. 1 to FIG. 3, the electrical receptacle connector 3000 includes a receptacle shell 1, a first terminal module 2A, a second terminal module 2B, a first grounding member 5, a second grounding member 6 and a shielding member B. The first terminal module 2A includes a first insulator 22, two first receptacle grounding contacts 3A, 3B, and a first signal contact set 9. The two first receptacle grounding contacts 3A, 3B and the first signal contact set 9 are disposed inside the first insulator 22. The first insulator 22 includes a first base portion 221 and a first tongue portion 222. Fixing portions of the first receptacle grounding contacts 3A, 3B and the first signal contact set 9 are disposed inside the first insulator 22. Flat plate portions of the first receptacle grounding contacts 3A, 3B and the first signal contact set 9 extend forwardly from the fixing portions thereof along a front-back direction of the electrical receptacle connector 3000. End portions of the first receptacle grounding contacts 3A, 3B and the first signal contact set 9 extend backwardly from the fixing portions thereof along the front-back direction of the electrical receptacle connector 3000. In this embodiment, the end portions of the first receptacle grounding contacts 3A, 3B and the first signal contact set 9 are Surface Mounted Technology (SMT) type.

The second terminal module 2B includes a second insulator 23, two second receptacle grounding contacts 4A, 4B, and a second signal contact set A. The second receptacle grounding contacts 4A, 4B and the second signal contact set A are disposed inside the second insulator 23. The second insulator 23 includes a second base portion 231 and a second tongue portion 232. Fixing portions of the second receptacle grounding contacts 4A, 4B and the second signal contact set A are disposed inside the second insulator 23. Flat plate portions of the second receptacle grounding contacts 4A, 4B and the second signal contact set A extend forwardly from the fixing portions thereof along a front-back direction of the electrical receptacle connector 3000. End portions of the second receptacle grounding contacts 4A, 4B and the second signal contact set A extend downwardly from the fixing portions thereof along the front-back direction of the electrical receptacle connector 3000. In this embodiment, the end portions of the second receptacle grounding contacts 4A, 4B and the second signal contact set 9 are Dual In-line Package (DIP) type. The first receptacle grounding contacts 3A, 3B and the first signal contact set 9 can be disposed in the first insulator 22 in an insert-molding manner or in an assembling manner. The second receptacle grounding contacts 4A, 4B and the second signal contact set A can be disposed in the second insulator 23 in an insert-molding manner or in an assembling manner.

Furthermore, the first insulator 22 is detachably assembled on the second insulator 23. When the first insulator 22 is assembled on the second insulator 23, the first insulator 22 and the second insulator 23 can cooperatively clamp the shielding member B, such that the shielding member B is able to be disposed between the first insulator 22 and the second insulator 23. The first insulator 22 is assembled with the second insulator 23 to form an insulation housing bracket 2. The insulation housing bracket 2 has a first side 20 and a second side 21 opposite to the first side 20, i.e., the first side 20 is located on the first insulator 22, and the second side 21 is located on the second insulator 23. In this embodiment, the second receptacle grounding contacts 4A, 4B and the second signal contact set A are disposed inside the second insulator 23 in an insert-molding manner, and a surface the second tongue portion 232 near the first side 21 is formed for accommodating the flat plate portions of the second receptacle grounding contacts 4A, 4B and the second signal contact set A. Afterwards, the first insulator 22 is assembled on the second insulator 23.

Figure 4:
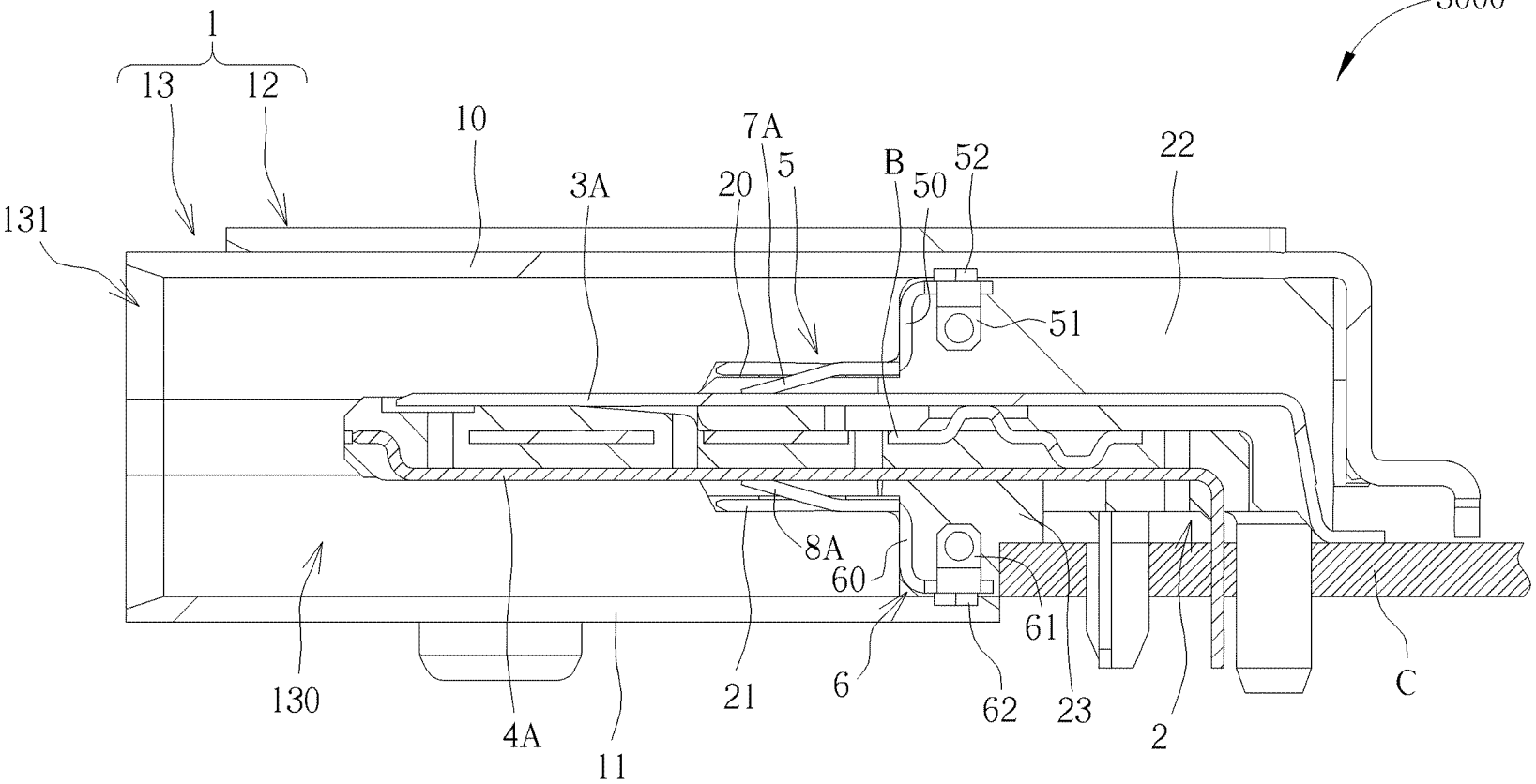
FIG. 4 is a sectional diagram of the electrical receptacle connector according to the first embodiment of the present invention.

Please refer to FIG. 1 to FIG. 4. FIG. 4 is a sectional diagram of the electrical receptacle connector 3000 according to the first embodiment of the present invention. As shown in FIG. 1 to FIG. 4, an accommodating space 130 is enclosed by the receptacle shell 1. The first receptacle contacts 3A, 3B, the first signal contact set 9, the second receptacle contacts 4A, 4B, the first terminal module 2A, and the second terminal module 2B are disposed inside the accommodating space 130. The first base portion 221 of the first insulator 22 of the first terminal module 2A and the second base portion 231 of the second insulator 23 of the second terminal module 2B are combined with the receptacle shell 1. Furthermore, the first grounding member 5 includes a first grounding body 50 and a pair of first mounting legs 51. The first grounding body 50 is a step-shaped structure which includes two horizontal portions and one vertical portion, wherein one horizontal portion and one vertical portion are fixed on the first base portion 221, and the other horizontal portion is fixed on the first tongue portion 222, so as to form the step-shaped first grounding body 50 corresponding to a step-shaped structure formed by combination of the first base portion 221 and the first tongue portion 222. The first grounding body 50 of the first grounding member 5 is installed on a side (i.e., the first side 20) of the first insulator 22 of the insulation housing bracket 2. The first mounting legs 51 protrude from the horizontal portion of the step-shaped first grounding body 50 toward the first insulator 22. When the first grounding member 5 is installed on the first insulator 22, the first mounting legs 51 can embed into the first insulator 22 for mounting the first grounding body 50 onto the first insulator 22.

Furthermore, the second grounding member 6 includes a second grounding body 60 and a pair of second mounting legs 61. The shielding body 60 of the second grounding member 6 is installed on a side (i.e., the second side 21) away from the first grounding body 50 and of second insulator 23 of the insulation housing bracket 2. The second grounding body 60 is a step-shaped structure which includes two horizontal portions and one vertical portion, wherein one horizontal portion and one vertical portion are fixed on the first base portion 221, and the other horizontal portion is fixed on the first tongue portion 222, so as to form the step-shaped first grounding body 50 corresponding to a step-shaped structure formed by combination of the first base portion 221 and the first tongue portion 222. The second mounting legs 61 protrude from the horizontal portion of the step-shaped second grounding body 60 toward the second insulator 23. When the second grounding member 6 is installed on the second insulator 23, the second mounting legs 61 can embed into the second insulator 23 for mounting the second grounding body 60 onto the second insulator 23.

In addition, the first grounding member 5 further includes two first connecting structures 7A, 7B, and the second grounding member further includes two connecting structures 8A, 8B. The first connecting structures 7A, 7B protrude from two opposite sides of the first grounding body 50 of the first grounding member 5 toward the first receptacle grounding contacts 3A, 3B and are integrally formed with the first grounding member 5. The second connecting structures 8A, 8B protrude from two opposite sides of the second grounding body 60 of the second grounding member 6 toward the second receptacle grounding contacts 4A, 4B and are integrated with the second grounding member 6.

It should be noted that, in this embodiment, the first receptacle grounding contacts 3A, 3B are located on two opposite sides of the first signal contact set 9. The first connecting structures 7A, 7B are disposed on two lateral sides of the first grounding body 50 of the first grounding member 5 and located corresponding to the first receptacle grounding contacts 3A, 3B, i.e., the first connecting structures 7A, 7B are configured at locations corresponding to the first receptacle grounding contacts 3A, 3B. Therefore, when the first grounding member 5 is installed on the first insulator 22 of the insulation housing bracket 2, the first connecting structures 7A, 7B can pass through two passing holes on the first tongue portion 222 of the insulation housing bracket 2 and abut against the first receptacle grounding contacts 3A, 3B, such that the first grounding member 5 mechanically contacts with the first receptacle grounding contacts 3A, 3B. In this embodiment, the first connecting structures 7A, 7B can be spring arms connected to the first grounding body 50 of the first grounding member 5. In other words, when the first grounding member 5 is installed on the first insulator 22 of the insulation housing bracket 2, the spring arms (i.e., the first connecting structures 7A, 7B) can resiliently abut against the first receptacle grounding contacts 3A, 3B, such that the first grounding member 5 is electrically connected to the first receptacle grounding contacts 3A, 3B.

In such a way, the first grounding member 5 is electrically connected to the first receptacle grounding contacts 3A, 3B, so that electromagnetic noises accumulated by signal contact sets (i.e., the first signal contact set 9 and the second signal contact set A) and the receptacle shell 1 of the electrical receptacle connector 3000 can be conducted to the first receptacle grounding contacts 3A, 3B during high frequency transmission. The electromagnetic noises on the first grounding member 5 are grounded to be eliminated, such that electromagnetic interferences of the electrical receptacle connector 3000 is reduced during high frequency transmission, which improves performance of high frequency transmission or high speed transmission of the electrical receptacle connector 3000. In practical application, the first connecting structures 7A, 7B can be resilient members protruding from the shielding member 5 or be integrally formed with the first grounding member 5 by stamping, but the present invention is not limited to hereto.

Similarly, in this embodiment, the second receptacle grounding contacts 4A, 4B are located on two opposite sides of the second signal contact set A. The second connecting structures 8A, 8B are disposed on two lateral sides of the second grounding body 60 of the second grounding member 6 and located corresponding to the receptacle grounding contacts 4A, 4B, i.e., the second connecting structures 8A, 8B are configured at locations corresponding to the receptacle grounding contacts 4A, 4B. Therefore, when the second grounding member 6 is installed on the second insulator 23 of the insulation housing bracket 2, the second connecting structures 8A, 8B can pass through two passing holes on the second tongue portion 232 of the insulation housing bracket 2 and mechanically connects the second grounding member 6 and the second receptacle grounding contacts 4A, 4B. In this embodiment, the second connecting structures 8A, 8B can be spring arms connected to the second grounding body 60 of the second grounding member 6. The spring arms (i.e., the second connecting structures 8A, 8B) can resiliently abut against the second receptacle grounding contacts 4A, 4B, such that the second grounding member 6 is electrically connected to the second receptacle grounding contacts 4A, 4B.

In such a way, the second grounding member 6 is electrically connected to the second receptacle grounding contacts 4A, 4B, so that electromagnetic noises accumulated by the signal contact sets (i.e., the first signal contact set 9 and the second signal contact set A) and the receptacle shell 1 of the electrical receptacle connector 3000 can be conducted to the second receptacle grounding contacts 4A, 4B during high frequency transmission. The electromagnetic noises on the second grounding member 6 are grounded to be eliminated, such that electromagnetic interferences of the electrical receptacle connector 3000 transmission is reduced during high frequency, which improves performance of high frequency transmission or high speed transmission of the electrical receptacle connector 3000. In practical application, the second connecting structures 8A, 8B can be resilient members protruding from the second grounding member 6, or be integrally formed with the second grounding member 6 by pressing, but the present invention is not limited to thereto.

In addition, the first grounding member 5 further includes a first abutting portion 52 protruding from the horizontal portion of the first grounding body 50 and located corresponding to the first base portion 221 of the first insulator 22. The second grounding member 6 further includes a second abutting portion 62 protruding from the horizontal portion of the second grounding body 60 and located corresponding to the second base portion 231 of the second insulator 23. The first abutting portion 52 is for abutting against the receptacle shell 1, such that the first grounding body 50 of the first grounding member 5 is electrically connected to the receptacle shell 1. The second abutting portion 62 is for abutting against the receptacle shell 1, such that the second grounding body 60 of the second grounding member 6 is electrically connected to the receptacle shell 1. Accordingly, the first abutting portion 52 can conduct electromagnetic noises accumulated on the receptacle shell 1 to the first receptacle grounding contacts 3A, 3B via the first grounding body 50 when the signal contact sets (i.e. the first signal contact set 9 and the second signal contact set A) of the electrical receptacle connector 3000 function in high frequency transmission or high speed transmission. The second abutting portion 62 can conduct electromagnetic noises accumulated on the receptacle shell 1 to the second receptacle grounding contacts 4A, 4B via the second grounding body 60 when the signal contact sets (i.e. the first signal contact set 9 and the second signal contact set A) of the electrical receptacle connector 3000 function in high frequency transmission or high speed transmission. The electromagnetic noises on the receptacle shell 1 are grounded to be eliminated via the first receptacle grounding contacts 3A, 3B and the second receptacle grounding contacts 4A, 4B, such that performance of high frequency transmission or high speed transmission of the electrical receptacle connector 3000 is improved.

Figure 5:
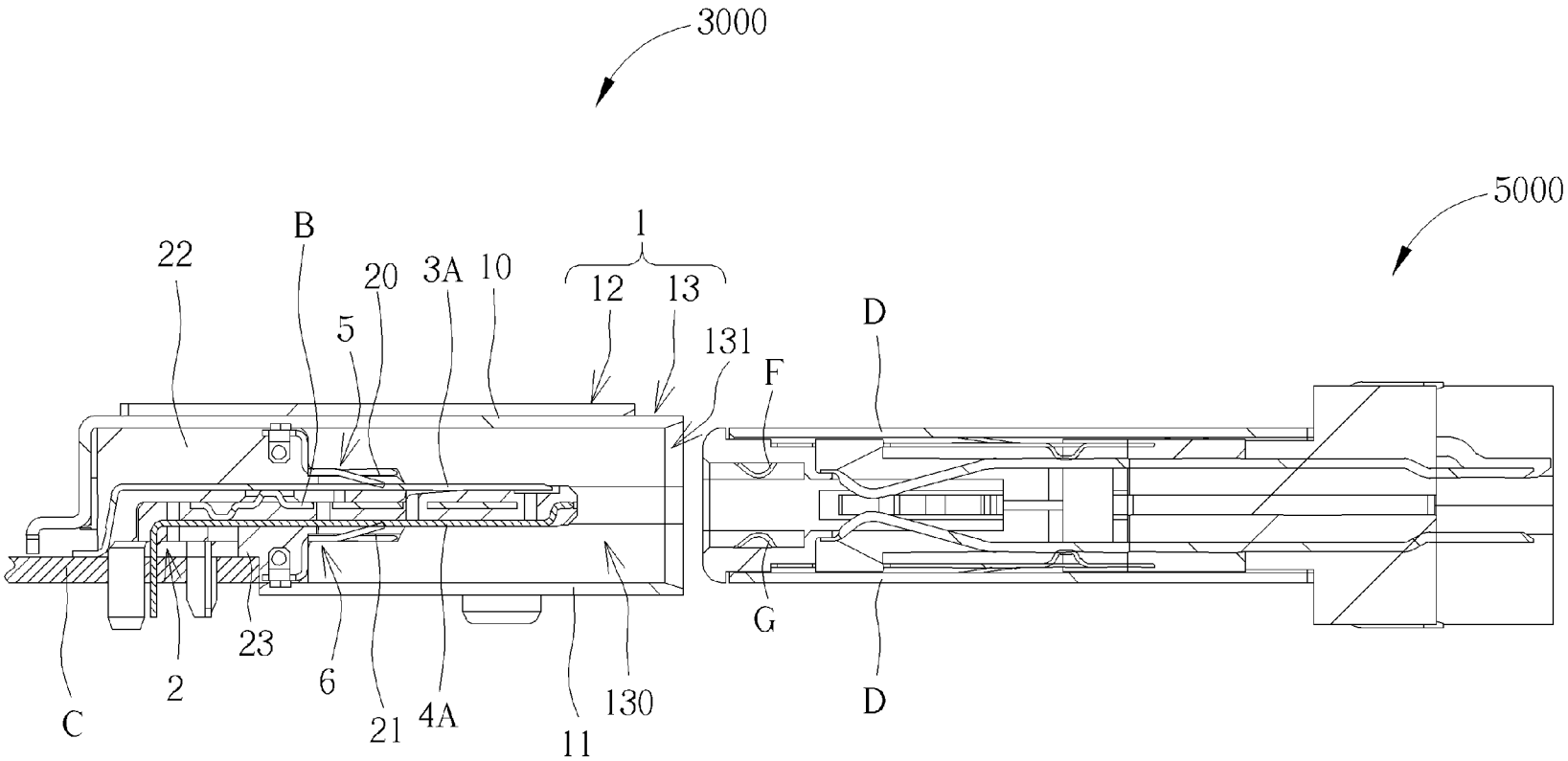
FIG. 5 is a sectional diagram of the electrical receptacle connector and a corresponding electrical plug connector according to the first embodiment of the present invention.

Please refer to FIG. 1 to FIG. 5. FIG. 5 is a sectional diagram of the electrical receptacle connector 3000 and a corresponding electrical plug connector 5000 according to the first embodiment of the present invention. As shown in FIG. 1 to FIG. 5, the receptacle shell 1 includes a first shell 13 and a second shell 12. The first shell 13 is fixed on the second shell 12. Furthermore, the second shell 12 includes a shell body 120 and a welding portion 121. The welding portion 121 protrudes from the shell body 120. In this embodiment, the second shell 12 can further include a plurality of first engaging structures 122 formed on a top surface of the shell body 120. The first engaging structure 122 can be a stamping structure. The first shell 13 can further include a plurality of first engaging slots 123 formed on a top surface of the first shell 13. The first engaging structure 122 engages with the first engaging slot 123 of the first shell 13 for fixing the shell body 120 on the first shell 13. Furthermore, in this embodiment, the second shell 12 can further include a plurality of second engaging structures 124 formed on two lateral surfaces of the shell body 120. The second engaging structure 124 can be a protrusion point structure stamped inwards relative to the shell body 120. A plurality of holes 125 can be further formed on the first shell 13. The second engaging structure 124 engages with the hole 125 for fixing the shell body 120 on the first shell 13. Finally, the shell body 120 is fixed onto the first shell 13 by laser welding. However, the present invention is not limited to thereto.

Furthermore, the welding portion 121 is mounted on a circuit board C, such that the shell body 120 is fixed on the circuit board C. Accordingly, the second shell 12 and the first shell 13 of the receptacle shell 1 can be fixed on the circuit board C together. Furthermore, the accommodating space 130 and a mating opening 131 are enclosed by the first shell 13. The accommodating space 130 is for accommodating the insulation housing bracket 2 and communicating with an outer side of the first shell 13 via the mating opening 131. The top surface of the first shell 13 further includes a plurality of restraining structures 126. The restraining structure 126 is formed on the top surface of the first shell 13 in a stamping manner. A plurality of restraining slots 223 is further formed on the first base portion 221 of the first insulator 22 and corresponding to the restraining structure 126. When the insulation housing bracket 2 is assembled in the accommodating space 130 of the first shell 13 via the mating opening 131, the restraining structure 126 engages with the restraining slot 223, so as to constrain the insulation housing bracket 2.

In such a way, the electrical plug connector 5000 can be inserted into the accommodating space 130 via the mating opening 131. When the electrical plug connector 5000 is inserted into the accommodating space 130 via the mating opening 131, the horizontal portion of the first grounding body 50 fixed on the first tongue portion 222 and the horizontal portion of the second grounding body 60 fixed on the second tongue portion 232 are able to mechanically contact with a resilient portion of a fourth shielding member F and a resilient portion of a fifth shielding member G of the electrical plug connector 5000. Accordingly, the first grounding body 50 and the second grounding body 60 are able to electrically connect a plug metal shell D of the electrical plug connector 5000 and the receptacle shell 1 with a ground end of the electrical receptacle connector 3000, which improves a grounding effect.

As shown in FIG. 2 to FIG. 5, the first grounding member 5 is disposed on the first side 20 of the insulation housing bracket 2, i.e., the first grounding member 5 is located between a top wall 10 of the receptacle shell 1 and the first insulator 22 of the insulation housing bracket 2. The first connecting structure 7A, 7B are disposed on the first grounding member 5. The second grounding member 6 is disposed on the second side 21 of the insulation housing bracket 2, i.e., the second grounding member 6 is located between a bottom wall 11 of the receptacle shell 1 and the second insulator 23 of the insulation housing bracket 2. The second connecting structures 8A, 8B are disposed on the second grounding member 6. It should be noted that the numbers of the first receptacle grounding contacts 3A, 3B, the first connecting structures 7A, 7B, the second receptacle grounding contacts 4A, 4B, and the second connecting structures 8A, 8B of the present invention are not limited to those illustrated in figures in this embodiment. For example, the electrical receptacle connector 3000 can include one first receptacle grounding contact, one first connecting structure, one second receptacle grounding contact and one second connecting structure as well.

Figure 6:
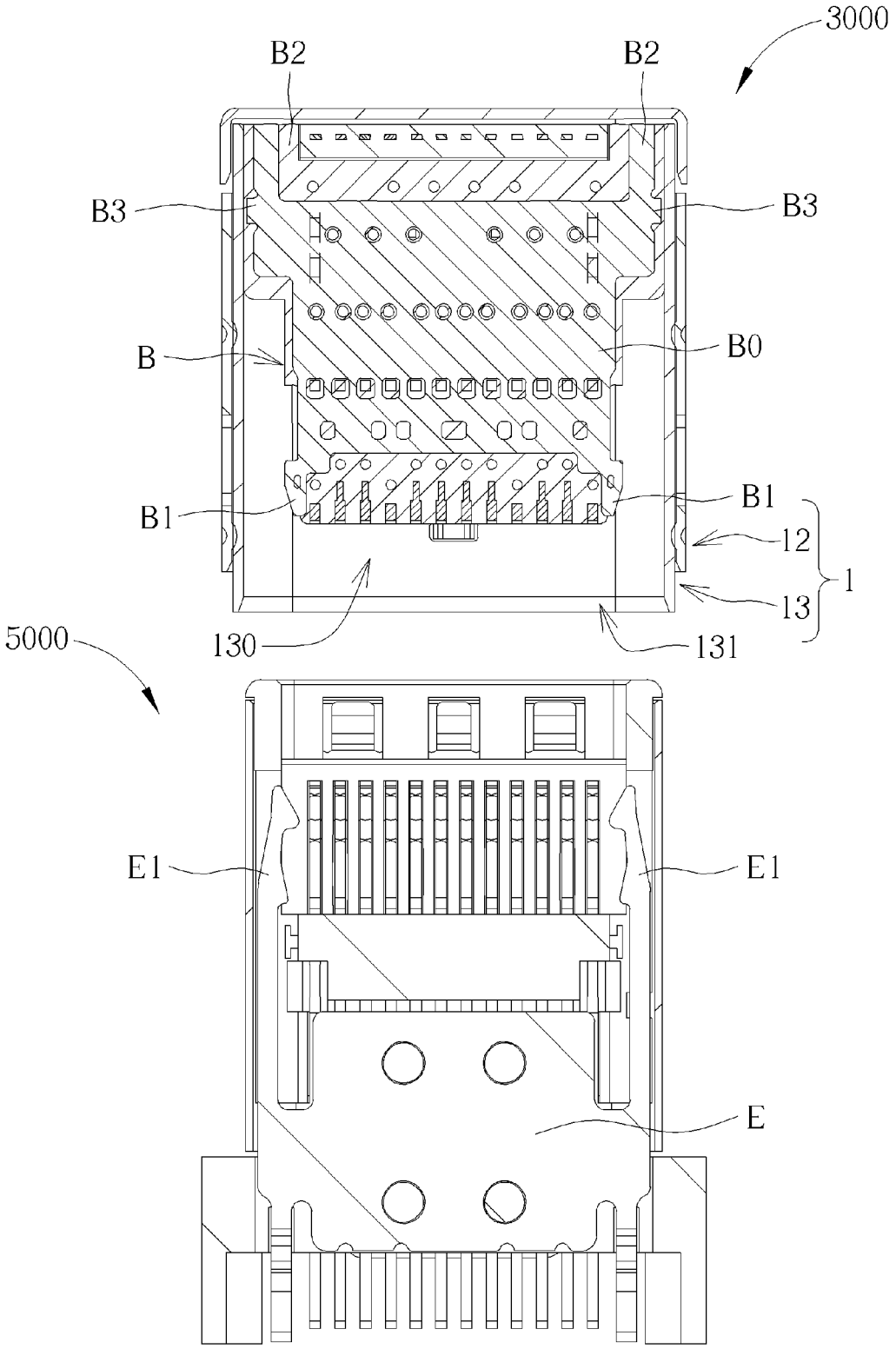
FIG. 6 is a sectional diagram of the electrical receptacle connector and a corresponding electrical plug connector in another view according to the first embodiment of the present invention.

Please refer to FIG. 2, FIG. 3, and FIG. 6. FIG. 6 is a sectional diagram of the electrical receptacle connector 3000 and the corresponding electrical plug connector 5000 in another view according to the first embodiment of the present invention. As shown in FIG. 2, FIG. 3, and FIG. 6, the first signal contact set 9 is arranged alongside the first receptacle grounding contacts 3A, 3B, and the second signal contact set A is arranged alongside the second receptacle grounding contacts 4A, 4B. In other words, the first signal contact set 9 and the first receptacle grounding contacts 3A, 3B are disposed alongside on the first side 20 of the insulation housing bracket, and the second signal contact set A and the second receptacle grounding contacts 4A, 4B are disposed alongside on the second side of the insulation housing bracket 2. Furthermore, in this embodiment, the electrical receptacle connector 3000 is a Universal Serial Bus Type-C (USB Type-C) electrical receptacle connector. From a front view of the mating opening 131 of the electrical receptacle connector 3000, pin assignment of the first signal contact set from left to right is a pair of first differential signal contacts (TX1+, TX1−), a first power contact ($V_{BUS}$), a first positioning contact (CC1), a pair of second differential signal contacts (D+, D−), an first auxiliary signal contact (SBU1), a second power contact ($V_{BUS}$), a pair of third differential signal contacts (RX2−, RX2+). Pin assignment of the second signal contact set from left to right is a pair of fourth differential signal contacts (RX1+, RX1−), a third power contact ($V_{BUS}$), a second auxiliary signal contact (SBU2), a pair of fifth differential signal contacts (D−, D+), a second positioning contact (CC2), a fourth power contact ($V_{BUS}$), a pair of sixth differential signal contacts (TX2−, TX2+). The third differential signal contacts (RX2−, RX2+), the first differential signal contacts (TX1+, TX1−), the sixth differential signal contacts (TX2−, TX2+), and the fourth differential signal contacts (RX1+, RX1−) can provide a signal satisfying a specification of USB 3.0 or USB 3.1. The second differential signal contact (D+, D−) and the fifth differential signal contacts (D−, D+) can provide a signal satisfying a specification of USB 2.0.

It should be noted that in this embodiment, the first receptacle grounding contacts 3A, 3B, the first differential signal contacts (TX1+, TX1−), the second differential signal contact (D+, D−), and the third differential signal contacts (RX2−, RX2+) of the first signal contact set 9 are symmetric to the second grounding contacts 4A, 4B, the fourth differential signal contacts (RX1+, RX1−), the fifth differential signal contacts (D−, D+), and the sixth differential signal contacts (TX2−, TX2+) of the second signal contact set A by rotation of 180 degrees along the front-back direction of the electrical receptacle connector 3000. In other words, each of the first signal contact set 9 and the second signal contact set A includes a plurality of pairs of differential signal contacts. The differential signal contacts of the first signal contact set 9 after rotation of 180 degrees is symmetric to the differential signal contacts of the second signal contacts A along the front-back direction of the electrical receptacle connector 3000. The third differential signal contacts (RX2−, RX2+) and the fourth differential signal contact (RX1+, RX1−) are compatible and capable of communicating with each other. The first differential signal contacts (TX1+, TX1−) and the sixth differential signal contact (TX2−, TX2+) are compatible and capable of communicating with each other. Pin assignment of the corresponding electrical plug connector 5000 is also symmetric by rotation of 180 degrees along a front-back direction of the electrical plug connector 5000. Therefore, no matter when the electrical receptacle connector 3000 is mated with the electrical plug connector 5000 with normal orientation (i.e., 0 degree) or with reverse orientation (i.e., 180 degrees), the electrical receptacle connector 3000 is able to normally transmit signals with the corresponding electrical plug connector 5000. Furthermore, it should be noted that each of the first grounding member 5 and the second grounding member 6 can be Electro Magnetic Interference (EMI) shielding members of the USB Type-C electrical receptacle connector, and the shielding member B can be a shielding plate of the USB Type-C electrical receptacle connector. The EMI shielding members (i.e., the first grounding member 5 and the second grounding member 6) are disposed at a top side and a bottom side of the insulation housing bracket 2 of the USB Type-C electrical receptacle connector (i.e., the electrical receptacle connector 3000), and the shielding plate (i.e., the shielding member B) is disposed between signal contact sets (i.e., the first signal contact set 9 and the second signal contact set A) of the USB Type-C electrical receptacle connector for reducing electromagnetic interferences between the signal contacts during high frequency transmission or high speed transmission.

When the USB Type-C electrical receptacle connector (i.e., the electrical receptacle connector 3000) transmit signals in high frequency, the EMI shielding members (i.e., the first grounding member 5 and the second grounding member 6) are for shielding the signal contact sets (i.e., the first signal contact set 9 and the second signal contact set A) and the receptacle shell 1, and the shielding plate (i.e., the shielding member B) is for shielding the signal contact sets of the USB Type-C electrical receptacle connector, so as to prevent electromagnetic interferences between the signal contact sets of the USB Type-C electrical receptacle connector. In such a way, the EMI shielding member and the shielding plate is capable of reducing electromagnetic noises and electromagnetic interferences of the USB Type-C electrical receptacle connector during high frequency transmission for improving performance of high frequency transmission or high speed transmission of the USB Type-C electrical receptacle connector and to ensuring normal operation of an electronic component (e.g., a mobile phone, a laptop, a tablet computer, a desktop computer, or a digital television) coupled to the USB Type-C electrical receptacle connector, and an electronic component coupled to the USB Type-C electrical plug connector.

In this embodiment, the first connecting structures 7A, 7B are disposed on the first grounding member 5, and the second connecting structures 8A, 8B are disposed on the second grounding member 6. The first insulator 22 and the second insulator 23 of the insulation housing bracket 2 of the electrical receptacle connector 3000 can clamp the shielding member B cooperatively. The shielding member B includes a shielding body B0, a latching structure B1, a grounding portion B2, and a fixing portion B3. The latching structure B1 extends from the shielding body B0. The grounding portion B2 extends from a side opposite to the latching structure B1 and of the shielding body. The fixing portion B3 protrudes from the shielding body B0 and located between the latching structure B1 and the grounding portion B2. The fixing portion B3 is for fixing with a circuit board. The grounding portion is coupled to a ground end of the circuit board such the shielding body B0 of the shielding body B is electrically connected to the ground end of the circuit board C.

Furthermore, when the electrical plug connector 5000 is connected to the electrical receptacle connector 3000, the latching structure B1 is for latching a resilient hook E1 of a shielding plate E of the electrical plug connector 5000. Accordingly, the latching structure B1 is not only for ensuring connection between the electrical plug connector 5000 and the electrical receptacle connector 3000, but also for electrically connecting the shielding body B0 of the shielding member B of the electrical receptacle connector 3000 and the shielding plate E of the electrical plug connector 5000. In such a way, when the electrical plug connector 5000 is connected to the electrical receptacle connector 3000, grounding paths between the electrical plug connector 5000 and the electrical receptacle connector 3000 can be established for improving a grounding effect.

Figure 7:
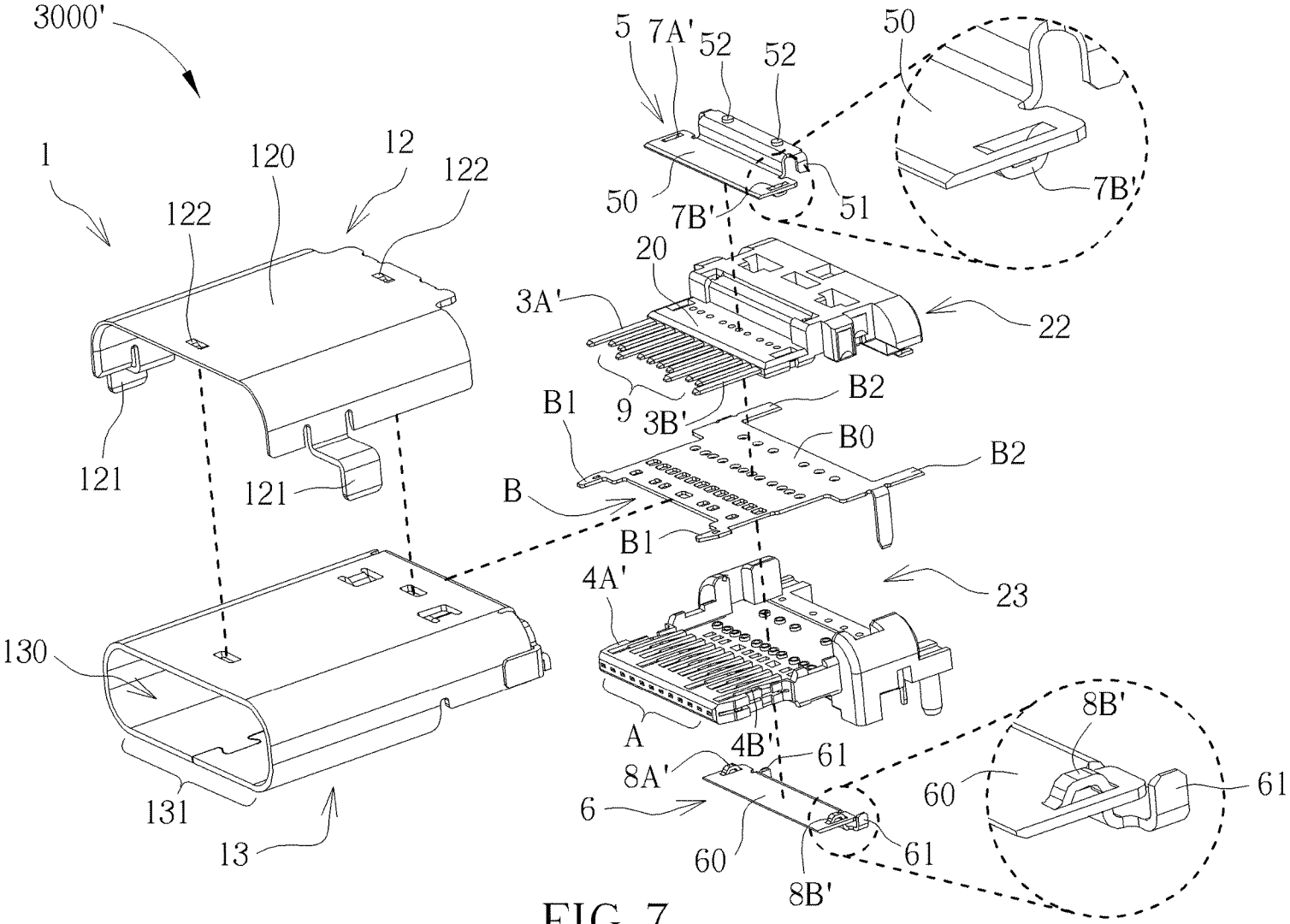
FIG. 7 is an exploded diagram of an electrical receptacle connector according to a second embodiment of the present invention.
Figure 8:
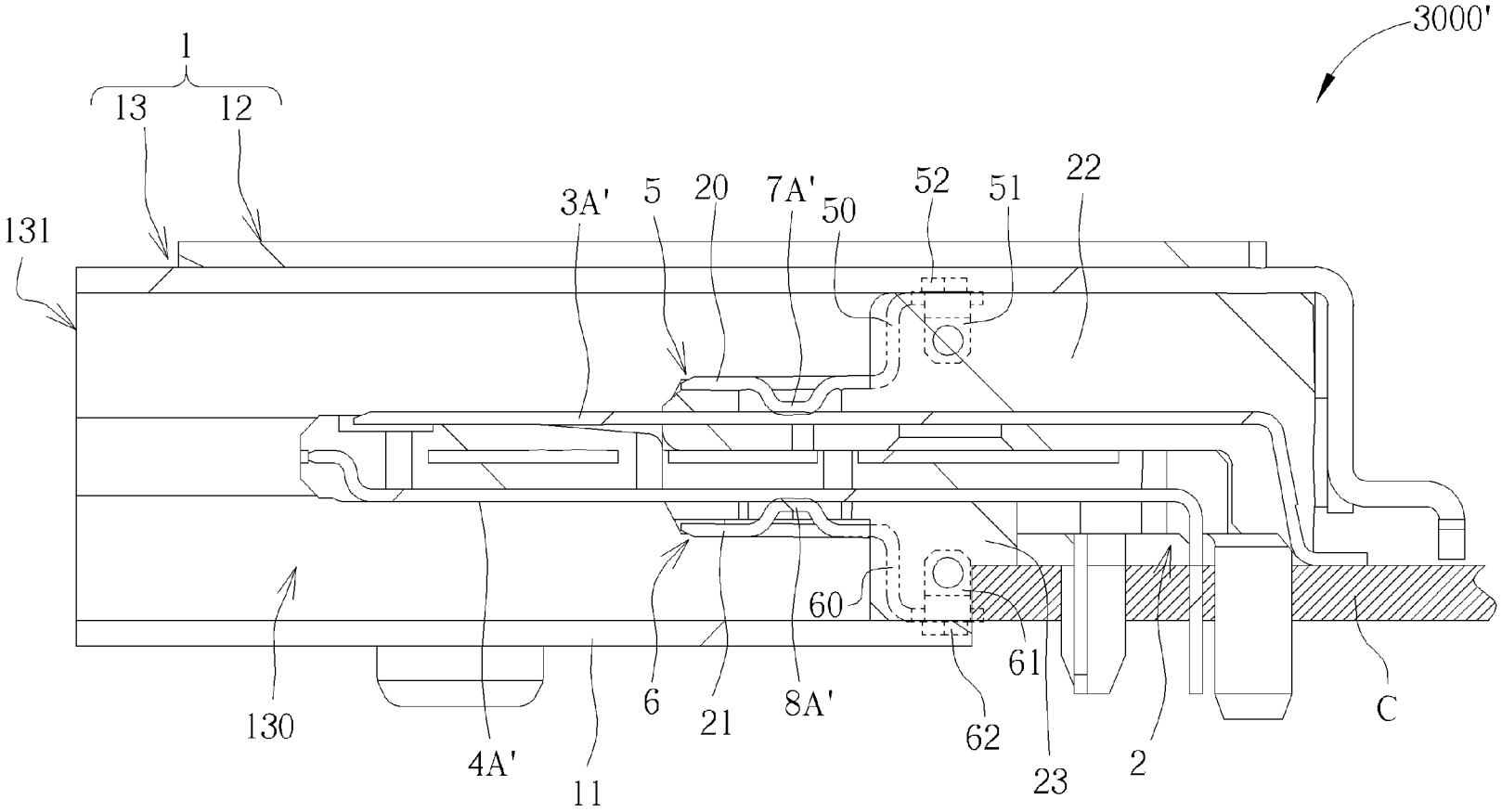
FIG. 8 is a sectional diagram of the electrical receptacle connector according to the second embodiment of the present invention.

Please refer to FIG. 7 and FIG. 8. FIG. 7 is an exploded diagram of an electrical receptacle connector 3000' according to a second embodiment of the present invention. FIG. 8 is a sectional diagram of the electrical receptacle connector 3000' according to the second embodiment of the present invention. As shown in FIG. 7 and FIG. 8, the main difference between the electrical receptacle connector 3000' and the aforesaid the electrical receptacle connector 3000 is that first connecting structures 7A', 7B' and second connecting structures 8A', 8B' of the electrical receptacle connector 3000' are protrusion portions, the first connecting structures 7A', 7B' and the first grounding member 5 are integrally formed, and the second connecting structures 8A', 8B' and the second grounding member 6 are integrally formed. The first connecting structures 7A', 7B' protrude from the first grounding member 5 and abut against first receptacle grounding contacts 3A', 3B', such that the first grounding member 5 is electrically connected to the first receptacle grounding contacts 3A', 3B'. The second connecting structures 8A', 8B' protrude from the second grounding member 6 and abut against second receptacle grounding contacts 4A', 4B', such that the second grounding member 6 is electrically connected to the second receptacle grounding contacts 4A', 4B'. Components with denoted in this embodiment identical to those in the aforesaid embodiment have identical structures and functions, and further description is omitted herein for simplicity.

Figure 9:
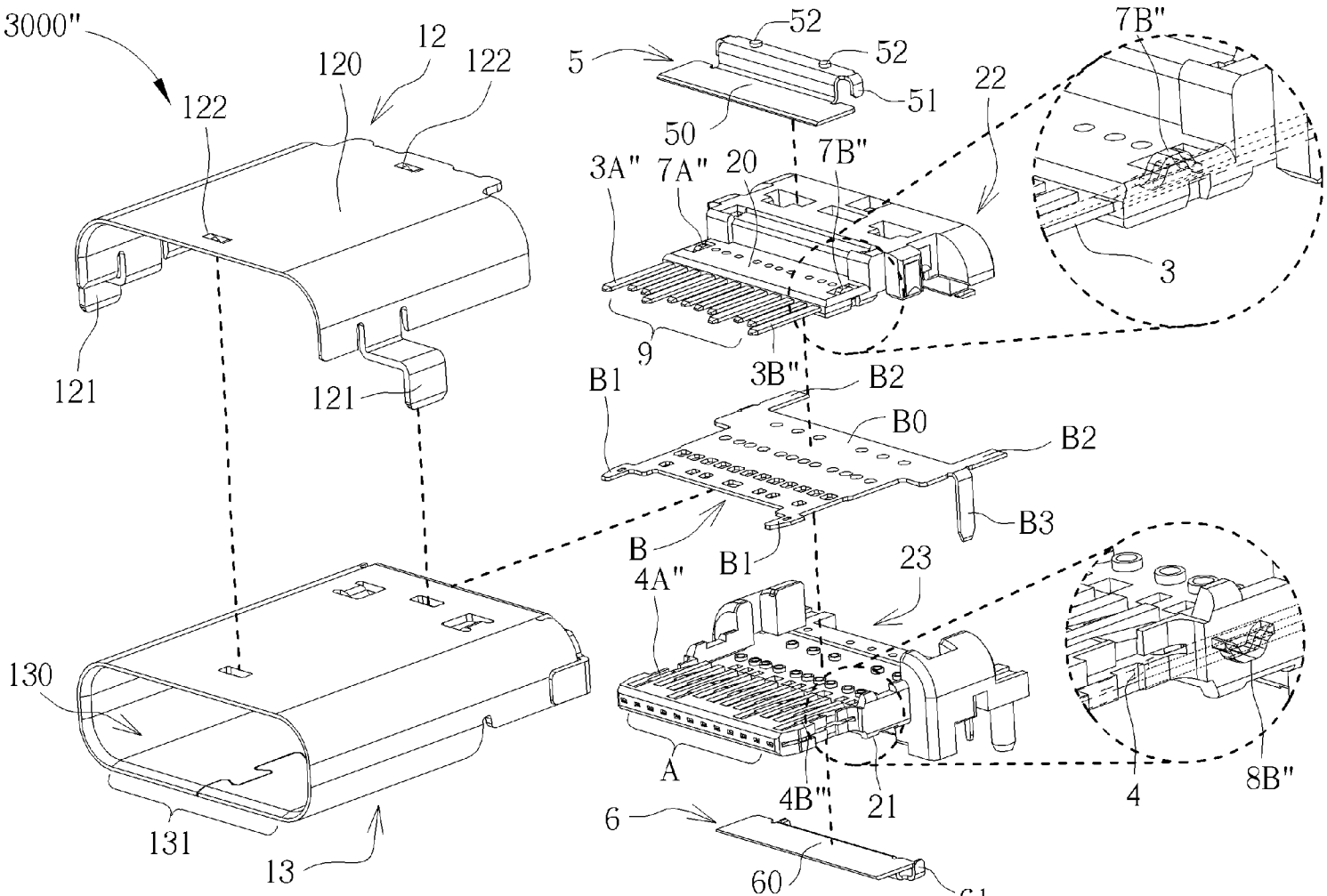
FIG. 9 is an exploded diagram of an electrical receptacle connector according to a third embodiment of the present invention.
Figure 10:
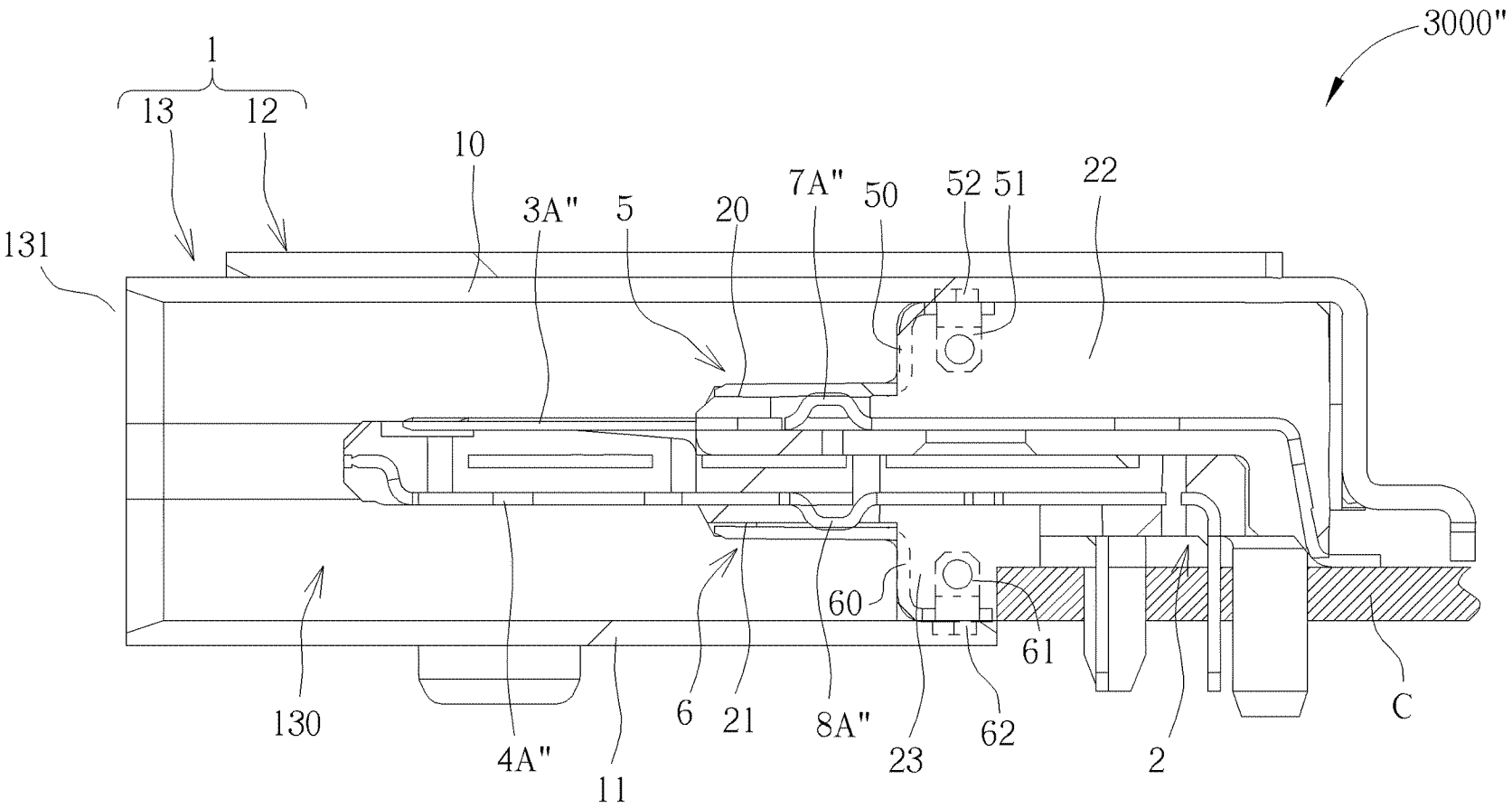
FIG. 10 is a sectional diagram of the electrical receptacle connector according to the third embodiment of the present invention.

Please refer to FIG. 9 and FIG. 10. FIG. 9 is an exploded diagram of an electrical receptacle connector 3000" according to a third embodiment of the present invention. FIG. 10 is a sectional diagram of the electrical receptacle connector 3000" according to the third embodiment of the present invention. As shown in FIG. 9 and FIG. 10, the main difference between the electrical receptacle connector 3000" and the electrical receptacle connector 3000 is that the first connecting structures 7A", 7B" and second connecting structures 8A", 8B" of the electrical receptacle connector 3000" are contact bending structures. The first connecting structures 7A", 7B" protrude from and are integrally formed with first receptacle grounding contacts 3A", 3B". The first connecting structures 7A", 7B" abut against the first grounding member 5, such that the first grounding member 5 is electrically connected to the first receptacle grounding contacts 3A", 3B". The second connecting structures 8A", 8B" protrude from and are integrally with second receptacle grounding contacts 4A", 4B". The second connecting structures 8A", 8B" abut against the second grounding member 6, such that the second grounding member 6 is electrically connected to the second receptacle grounding contacts 4A", 4B". Components with denoted in this embodiment identical to those in the aforesaid embodiment have identical structures and functions, and further description is omitted herein for simplicity.

In contrast to the prior art, the present invention utilizes the first connecting structures and the first abutting portion for electrically connecting the receptacle shell, the first grounding member, and the first receptacle grounding contact, and further utilizes the second connecting structures and the second abutting portion for electrically connecting the receptacle shell, the second grounding member, and the second receptacle grounding contact, such that electromagnetic noises and electromagnetic interferences are reduced when the electrical receptacle connector is transmitting high frequency signals, which improves performance of high frequency transmission or high speed transmission of the electrical receptacle connector. Furthermore, the present invention further utilizes the shielding member disposed between the first signal contact set and the second signal contact set for shielding the first signal contact set and the second signal contact set for preventing interferences and crosstalk generated between the first signal contact set and the second signal contact set.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electrical receptacle connector, comprising:

an insulation housing bracket having a first side;

a first receptacle grounding contact disposed inside the insulation housing bracket;

a first shell with an accommodating space enclosed therein, the accommodating space being for accommodating the insulation housing bracket and the first receptacle grounding contact; and a first grounding member disposed on the first side of the insulation housing bracket and located between the insulation housing bracket and the first shell, wherein the first grounding member contacts with the first receptacle grounding contact such that the first grounding member is electrically connected to the first receptacle grounding contact.

2. The electrical receptacle connector of claim 1, wherein the first grounding member comprises a first connecting structure protruding from the first grounding member and contacting with the first receptacle grounding contact, such that the first grounding member is electrically connected to the first receptacle grounding contact.

3. The electrical receptacle connector of claim 2, wherein the first connecting structure is a protrusion portion or a spring arm, and the first connecting structure and the first grounding member are integrally formed.

4. The electrical receptacle connector of claim 1, wherein the first receptacle grounding contact comprises a first connecting structure protruding from the first receptacle grounding contact and contacting with the first grounding member, such that the first grounding member is electrically connected to the first receptacle grounding contact.

5. The electrical receptacle connector of claim 4, wherein the first connecting structure is a contact bending structure, and the first connecting structure and the first receptacle grounding contact are integrally formed.

6. The electrical receptacle connector of claim 1, wherein the insulation housing bracket has a second side opposite to the first side, and the electrical receptacle connector further comprises:

a second receptacle grounding contact disposed inside the insulation housing bracket and opposite to the first receptacle grounding contact; and a second grounding member disposed on the second side of the insulation housing bracket and located between insulation housing bracket and the first shell, wherein the second grounding member contacts with the second receptacle grounding contact such that the second grounding member is electrically connected to the second receptacle grounding contact.

7. The electrical receptacle connector of claim 6, wherein the second grounding member comprises a second connecting structure protruding from the second grounding member and contacting with the second receptacle grounding contact, such that the second grounding member is electrically connected to the second receptacle grounding contact, wherein the second connecting structure is a protrusion portion or a spring arm, and the second connecting structure and the second grounding member are integrally formed.

8. The electrical receptacle connector of claim 6, wherein the second receptacle grounding contact comprises a second connecting structure protruding from the second receptacle grounding contact and contacting with the second grounding member, such that the second grounding member is electrically connected to the second receptacle grounding contact, wherein the second connecting structure is a contact bending structure, and the second connecting structure and the second receptacle grounding contact are integrally formed.

9. The electrical receptacle connector of claim 6, further comprising:

a first signal contact set arranged alongside the first receptacle grounding contact;

a second signal contact set arranged alongside the second receptacle grounding contact; and a shielding member disposed between the first signal contact set and the second signal contact set, the shielding member being for shielding the first signal contact set and the second signal contact set.

10. The electrical receptacle connector of claim 9, wherein the insulation housing bracket comprises a first insulator and a second insulator, the second insulator is detachably assembled on the first insulator, the first grounding member is installed on the first insulator, the second grounding member is installed on the second insulator, and the first insulator and the second insulator clamp the shielding member cooperatively.

11. The electrical receptacle connector of claim 10, wherein the first grounding member comprises:

a first grounding body installed on a side of the first insulator; and a first abutting portion protruding from the first grounding body, the first abutting portion abutting against the first shell, such that the first grounding body is electrically connected to the first shell.

12. The electrical receptacle connector of claim 11, wherein the second grounding member comprises:

a second grounding body installed on a side away from the first grounding body and of the second insulator; and a second abutting portion protruding from the second grounding body, the second abutting portion abutting against the first shell, such that the second grounding body is electrically connected to the first shell.

13. The electrical receptacle connector of claim 12, wherein the first grounding member further comprises a first mounting leg protruding from the first grounding body and embedding into the first insulator, and the second grounding member further comprises a second mounting leg protruding from the second grounding body and embedding into the second insulator.

14. The electrical receptacle connector of claim 9, wherein the shielding member comprises:

a shielding body;

a latching structure protruding from the shielding body and being for latching an electrical plug connector;

a grounding portion protruding from a side opposite to the latching structure and of the shielding body, the grounding portion being coupled to a circuit board; and a fixing portion protruding from the shielding body and located between the latching structure and the grounding portion, the fixing portion being for fixing with the circuit board.

15. The electrical receptacle connector of claim 1, further comprising a second shell, wherein the second shell comprises:

a casing fixed on the first shell in a laser welding manner; and a welding portion protruding from the casing and being mounted on a circuit board.

16. The electrical receptacle connector of claim 15, wherein the second shell further comprises a first engaging structure being formed on the casing and engaging with the first shell.

17. An electrical receptacle connector, comprising:

a first terminal module comprising:

a first insulator;

a first signal contact set disposed inside the first insulator; and two first receptacle grounding contacts disposed inside the first insulator and arranged alongside the first signal contact set, the two first receptacle grounding contacts being disposed on two opposite sides of the first signal contact set respectively;

a second terminal module comprising:

a second insulator assembled with the first insulator to form an insulation housing bracket;

a second signal contact set disposed inside the second insulator; and two second receptacle grounding contacts disposed inside the second insulator and arranged alongside the second signal contact set, the two second receptacle grounding contacts being disposed on two opposite sides of the second signal contact set respectively;

a first shell with an accommodating space enclosed therein, the accommodating space being for accommodating the first terminal module and the second terminal module; and a first grounding member disposed on a first side of the insulation housing bracket and located between the insulation housing bracket and the first shell, the first grounding member mechanically contacting with the first receptacle grounding contact, such that the first grounding member is electrically connected to the first receptacle grounding contact.

18. The electrical receptacle connector of claim 17, further comprises a second shell, wherein the second shell comprises:

a casing fixed on the first shell in a laser welding manner; and a welding portion protruding from the casing and being mounted on a circuit board.

19. The electrical receptacle connector of claim 17, wherein each of the first signal contact set and second signal contact set comprises at least two pairs of differential signal contacts, the differential signal contacts of the first signal contact is symmetric to the differential signal contacts of the second signal contact set by rotation of 180 degrees along a front-back direction of the electrical receptacle connector.

20. The electrical receptacle connector of claim 17, wherein the first grounding member comprises a first connecting structure protruding from the first grounding member and contacting with the first receptacle grounding contact, such that the first grounding member is electrically connected to the first receptacle grounding contact.

21. The electrical receptacle connector of claim 20, wherein the first connecting structure is a protrusion portion or a spring arm, and the first connecting structure and the first grounding member are integrally formed.

22. The electrical receptacle connector of claim 17, wherein the first receptacle grounding contact comprises a first connecting structure protruding from the first receptacle grounding contact and contacting with the first grounding member, such that the first grounding member is electrically connected to the first receptacle grounding contact.

23. The electrical receptacle connector of claim 22, wherein the first connecting structure is a contact bending structure, and the first connecting structure and the first receptacle grounding contact are integrally formed.

24. The electrical receptacle connector of claim 17, further comprising a second grounding member disposed on a second side of the insulation housing bracket opposite to the first side and located between the insulation housing bracket and the receptacle shell, the second grounding member is electrically connected to the second receptacle grounding contact in a mechanically contacting manner.

25. The electrical receptacle connector of claim 24, wherein the second grounding member comprises a second connecting structure protruding from the second grounding member and contacting with the second receptacle grounding contact, such that the second grounding member is electrically connected to the second receptacle grounding contact, wherein the second connecting structure is a protrusion portion or a spring arm, and the second connecting structure and the second grounding member are integrally formed.

26. The electrical receptacle connector of claim 24, wherein the second receptacle grounding contact comprises a second connecting structure protruding from the second receptacle grounding contact and contacting with the second grounding member, such that the second grounding member is electrically connected to the second receptacle grounding contact, wherein the second connecting structure is a contact bending structure, and the second connecting structure and the second receptacle grounding contact are integrally formed.

* * * * *